US005572310A

United States Patent [19]

Hoberock et al.

[11] Patent Number: 5,572,310

[45] Date of Patent: Nov. 5, 1996

[54] UNIVERSAL MEDIA SIZE DIAL

[75] Inventors: Tim M. Hoberock, Boise; R. Scott Johnson, Nampa; Paul K. Mui, Boise, all of Id.

[73] Assignee: Hewlett-Packard Company, Palo Alto, Calif.

[21] Appl. No.: 590,536

[22] Filed: Jan. 24, 1996

[51] Int. Cl.[6] ..... G03G 21/00; B65H 1/00

[52] U.S. Cl. ..... 399/370; 271/145; 271/171

[58] Field of Search ..... 355/308, 311, 355/309; 271/9.06, 145, 171, 223; 221/2, 4

[56] References Cited

U.S. PATENT DOCUMENTS 4,697,803 10/1987 Kan et al. ..... 271/171 X

FOREIGN PATENT DOCUMENTS 6-211360 8/1994 Japan .

*Primary Examiner*—Nestor R. Ramirez
*Attorney, Agent, or Firm*—Anthony J. Baca

[57] ABSTRACT

There is provided an apparatus for conveying a media's size to a printing system. First there is a rotatable shaft. Several cams are formed around the shaft. Each cam has a lobe extending beyond the radius of the shaft. A number of levers, one for each cam, pivot about a pivot point and have a tab that is adjacent to a corresponding cam. An indicator wheel is also attached to the shaft. The indicator wheel has a first set of faces located around the circumference of the indicator wheel, where each face indicates a media size. The indicator wheel has another set of faces that indicate a second set of media sizes. Finally, there is a slidable lever positioned adjacent to the indicator wheel. When the slidable lever is in a first position, only media sizes in the first set are visible and the presently visible size is the size conveyed to the printing system. Similarly, when the slidable lever is in a second position, only media sizes in the second set are visible and the presently visible size is the size conveyed to the printing system.

10 Claims, 19 Drawing Sheets

UNIVERSAL MEDIA SIZE DIAL

TECHNICAL FIELD

The present invention relates to media trays and more particularly, to an arrangement for visually displaying to the user the size of the media presently in the media tray.

BACKGROUND OF THE INVENTION

In the art of printing, it is desirable that the printing device know the size of the media, such as paper, transperancies, or other sheets, in the supply tray. Without media size information, an error can occur during printing if the media size requested is not the same as the media size in the supply. If the printing system knows the media size in the supply tray, the user can be notified that the present media supply does not agree with the requested size, thereby, reducing the likelihood of an error.

Prior to the present invention, several methods of conveying the contents of a media tray to the printing device have been developed. For example, a unique tray for each size of media that the printing device can accommodate will insure that only one size of media can be inserted in the tray. The primary disadvantage with this approach is increased cost in molding numerous size and configured trays. Additional disadvantages include increased cost in maintaining inventory of these numerous trays. For the user, they must accommodate storage of those trays not presently in use. Also, the user generally must purchase, at an additional cost, trays which are not initially provided with the printer.

Another approach, allows the manufacturer to manufacture one type of media tray that can be configured for the various sizes of media. This approach reduces manufacturing cost by requiring one molding for all media trays. However, it requires that the user indicate to the printer the size of media in the tray. A common method of indicating to the printer the size of media in the tray requires the user to actually "punch out" a particular location in the media tray. Once punched out, the tray is permanently configured for that particular media size. If the user wishes to use a different media size, the user must purchase a new tray.

SUMMARY OF THE INVENTION

The present invention is an apparatus for conveying a media's size to a printing system. First there is a rotatable shaft. Several cams are formed around the shaft, where each cam has a lobe extending beyond the radius of the shaft. There is also a number of levers, one for each cam. Each lever pivots about a pivot point and has a tab that is adjacent to a corresponding cam. When the shaft is rotated such that a lobe presses against a tab, the corresponding lever pivots about the pivot point.

An indicator wheel is also attached to the shaft. The indicator wheel has a first set of faces located around the circumference of the indicator wheel, where each face indicates a media size. The indicator wheel also has another set of faces that indicate a second set of media sizes. Finally there is a slidable lever positioned adjacent to the indicator wheel. When the slidable lever is in a first position, only media sizes in the first set are visible and the presently visible size is the size conveyed to the printing system. Similarly, when the slidable lever is in a second position, only media sizes in the second set are visible and the presently visible size is the size conveyed to the printing system

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
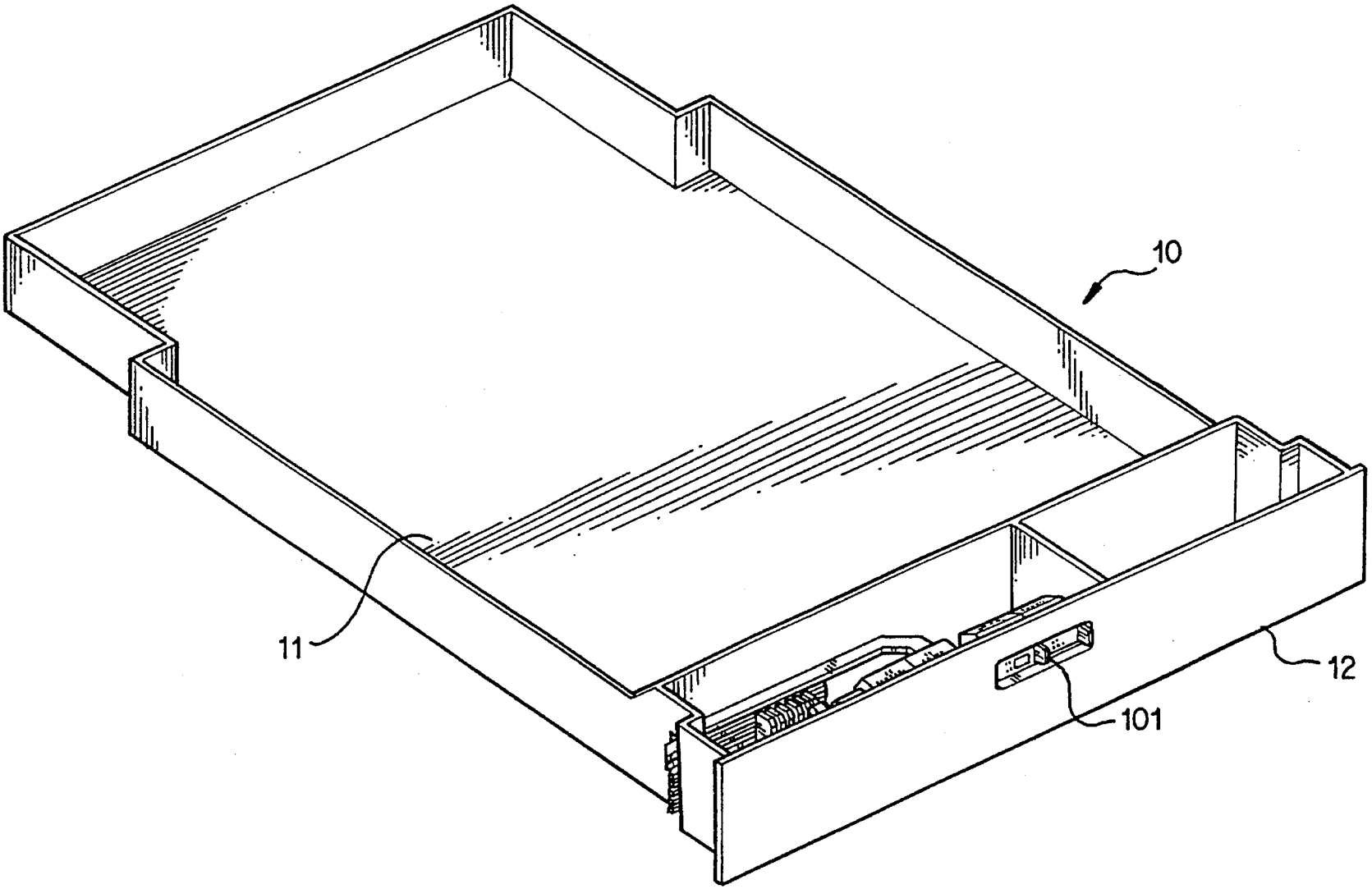
FIG. 1 is a perspective view of the universal media tray.

The present invention is not limited to a specific embodiment illustrated herein. Referring first to FIG. 1 where a first embodiment of the present invention is shown. The first embodiment is embodied in media tray 10. Media of varying sizes may be placed in media tray 10 in the general area of tray 11. After inserting the media in tray 11, the user must properly configured indicator selector 101 to agree with the size of media in media tray 10. As will be described later, as the user manipulations the indicators in indicator selection 101, information is conveyed to the imaging system when media tray 10 is inserted therein.

Figure 2:
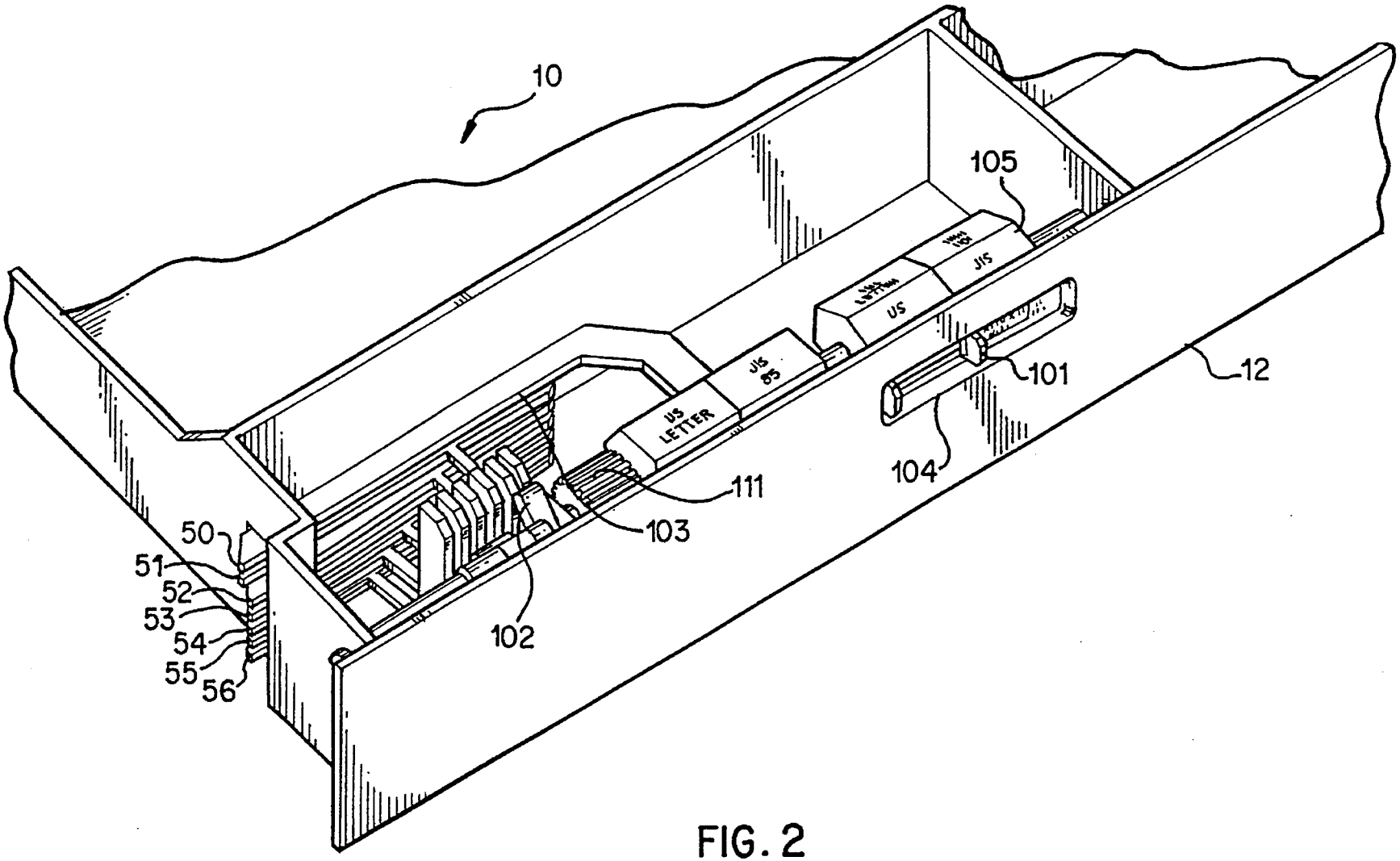
FIG. 2 provides a close-up, cut-away view of a first embodiment.

The area of interest from FIG. 1 is shown in greater detail in FIG. 2. As the user manipulates indicated selector 101 and thumb wheel 111, levers 50 through 56 are actuated, in part, by cam 102 to a unique pattern for each given media size. As media tray 10 is inserted in the imaging system, levers 50 through 56 activate switches within the imaging system. The imaging system may then read these switches thereby understanding what size of media is presently installed in that media tray 10.

Figure 3:
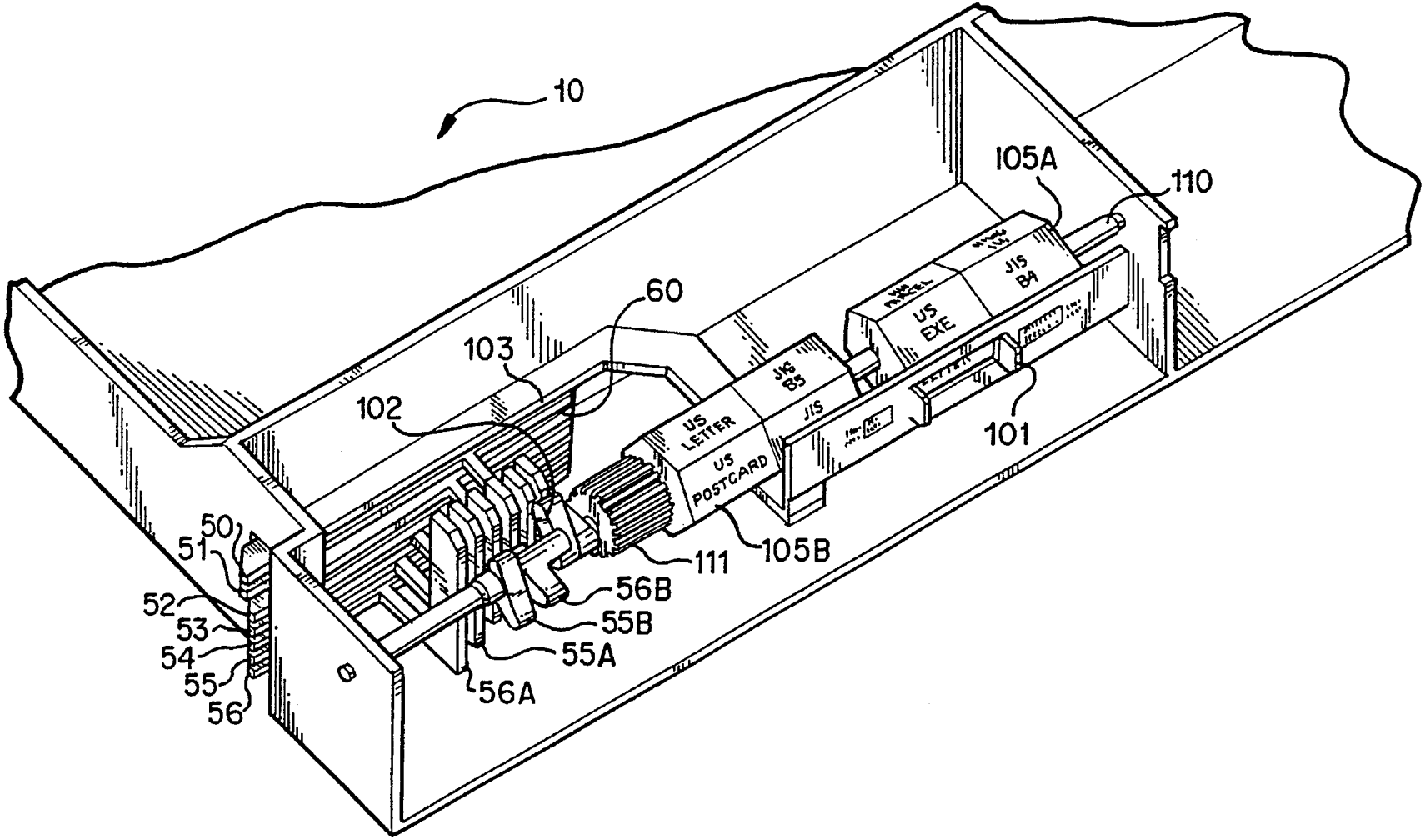
FIG. 3 is from the same angle as that for FIG. 2 however, the front plate has been removed.

To better understand the workings of the indicator, face plate 12 is removed in FIG. 3. In the embodiment in FIG. 3, the user must manipulate both indicator selector 101 and thumb wheel 111. Indicator selector 101 moves in a lateral motion along the plane defined by face plate 12. As indicator selector 101 is laterally moved, lever 50 also moves lateral by means of indicator arm 103. In the first embodiment, indicator selector selects between two configurations; namely one for U.S. media and another for international media. Individual media sizes within either of the aforementioned groups are selected by rotating thumb wheel 111 such that the desired indicator is viewable through indicator selector 101. A second indicator assembly 105B is provided that the use may view while rotating thumb wheel 111. Without indicator assembly 105B, the user would be forced to look at the indicator assembly 105A through indicator window 104 (shown in FIG. 2) while rotating thumb wheel 111.

Still referring to FIG. 3, levers 50 through 56 are shown in the position for U.S. LETTER size media. In particular, levers 50 and 51 are in the "on" position. Shaft 110 is rotated such that lobe 51B depresses tab 51A thereby pivoting lever 51 about pivot 60 placing lever 51 in the "on" position. Indicator selector 101 is shown in the left position allowing the label U.S. LETTER on indicator assembly 105A to display through indicator window 104. Simultaneously, indicator assembly 105B displays to the user looking down at the tray that either U.S. letter or JIS B5 size media may be selected.

If the user rotates shaft 110 through thumb wheel 111 such that indicator assembly 105B displayed U.S. POSTCARD, lobe 51B no longer depress tab 51A instead, lobe 52B depress tab 52A causing lever 52 to pivot about pivot point 60. In a similar manner, as shaft 110 I rotated lobes 53B through 56B depress tabs 53A through 56A pivoting their respective levers about pivot point 60. Therefore, in the embodiment of FIG. 3 a total of 12 different sizes of media are possible.

One skilled in the art would understand that the number of possible media sizes may be increased by adding additional lobes and their associated tabs and levers to shaft 110. However, adding additional lobes as just described will quickly create a rather large and cumbersome mechanism. Another approach to increasing number of representable media sizes can be accomplished by using, for example, a binary code scheme whereby levers 50 through 56 encode a binary number. By using a binary scheme, the seven levers (50–56) could represent a total of 128 possible media sizes.

Figure 4:
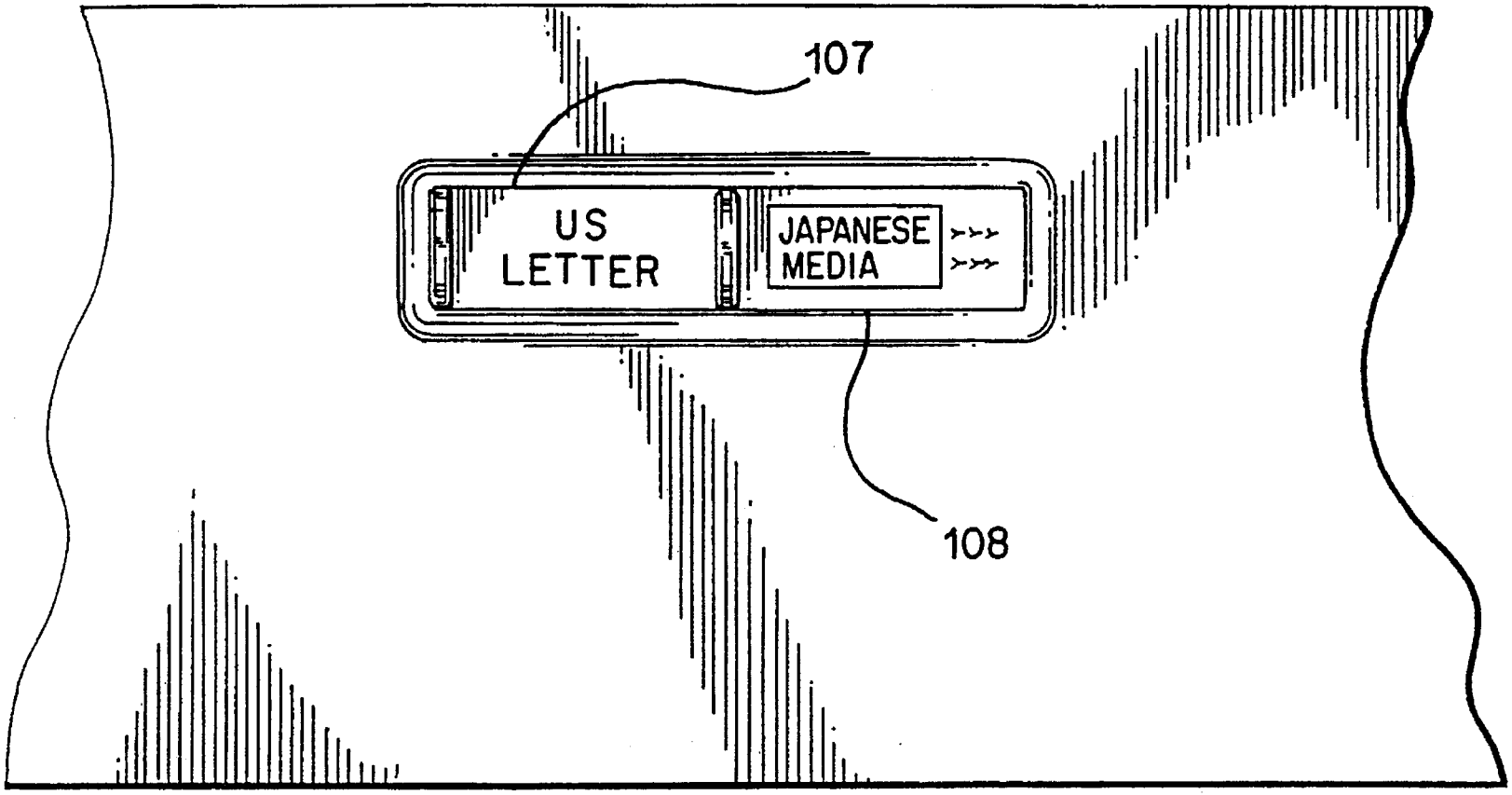
FIG. 4 is front view showing the indicator selector in greater detail.

In FIG. 4, the front of media tray 10 can be seen in more detail. As shown, left indicator window 107 indicates that media size "U.S. Letter" has been chosen. Right indicator window 108 indicates that Japanese media may be selected by sliding indicator selector to the right. Assuming the user desires to select Japanese media, the user must slide indicator selector 101 to the right.

Figure 5:
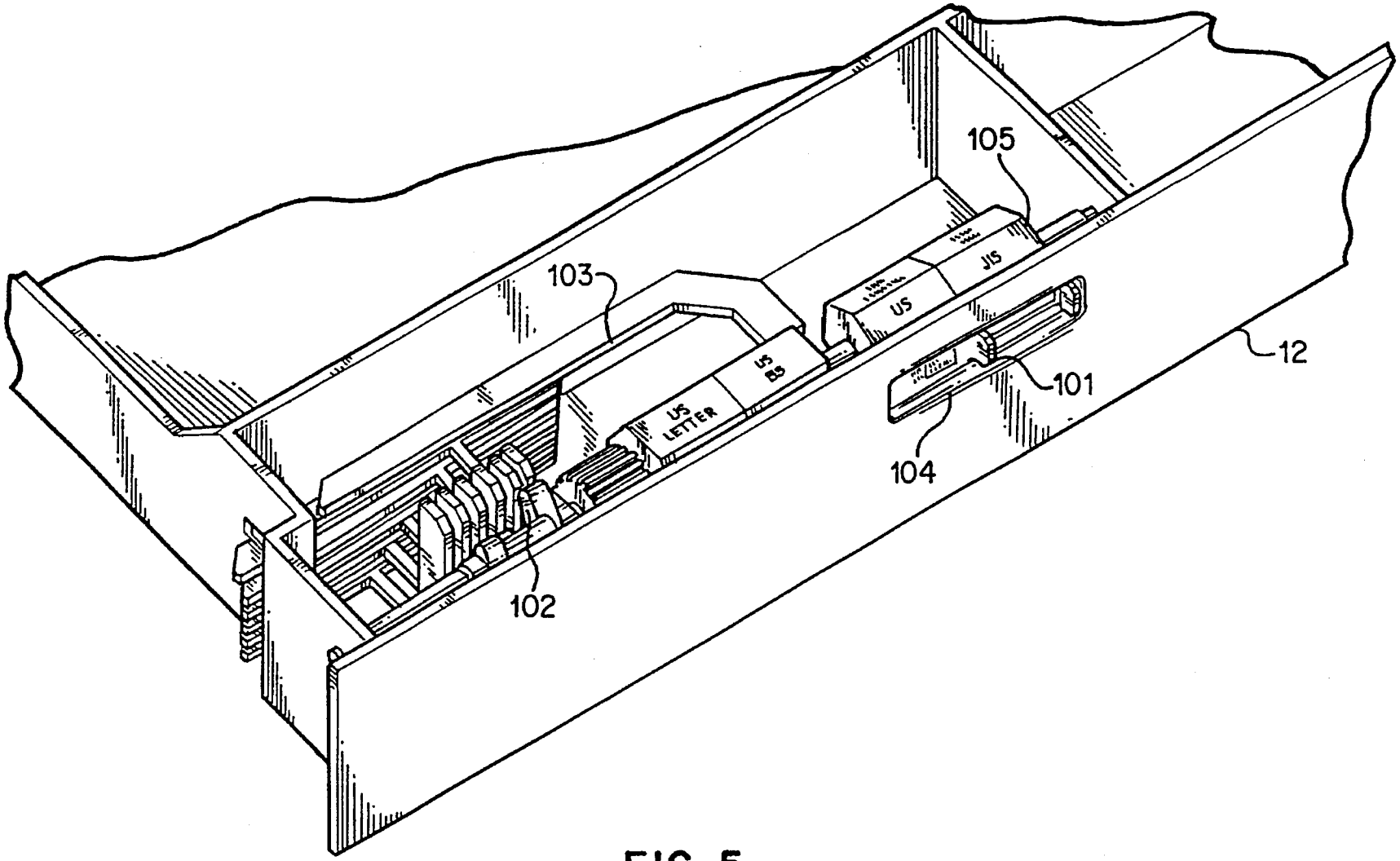
FIG. 5 provides a close-up, cut-away view of the first embodiment.
Figure 6:
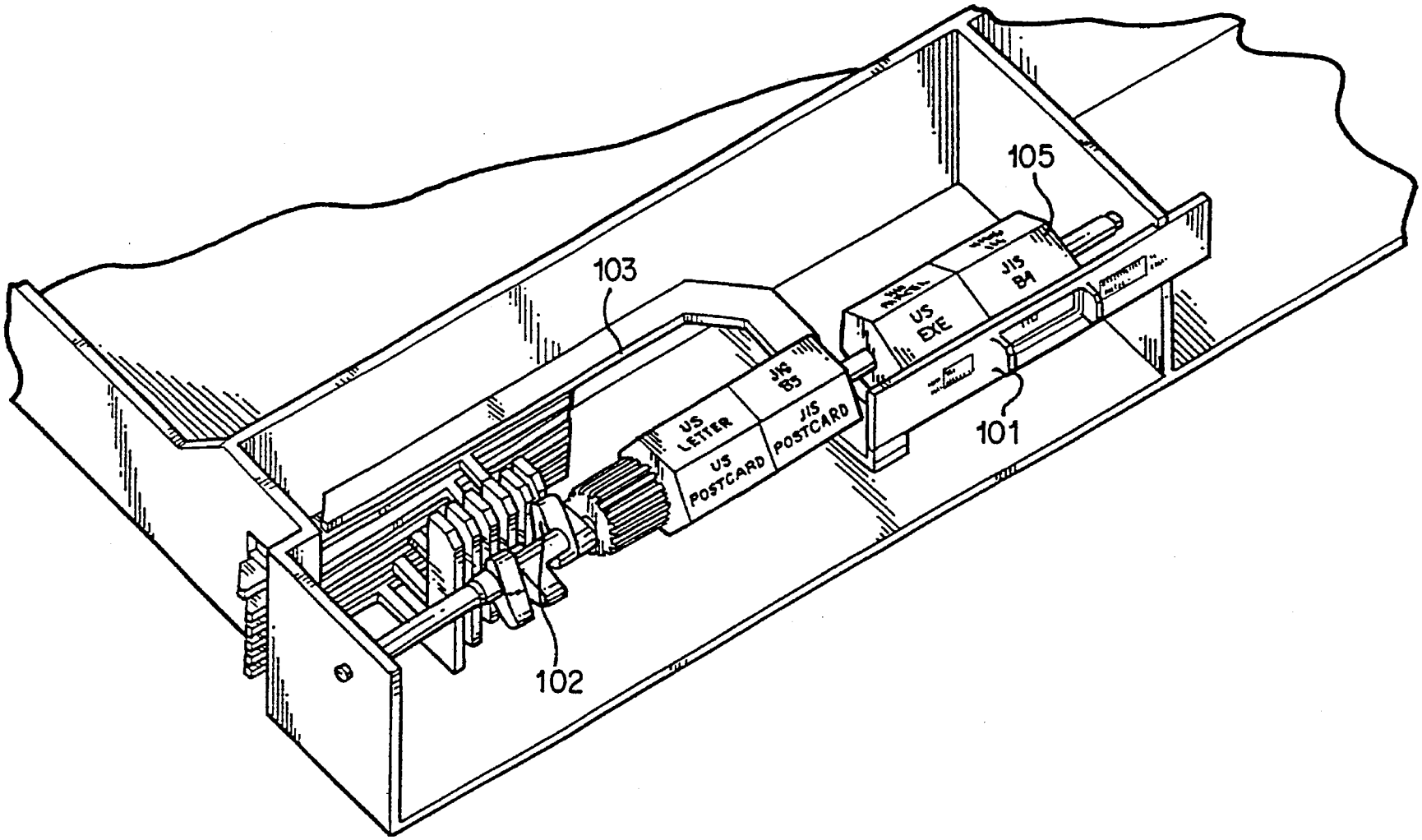
FIG. 6 is from the same angle as that for FIG. 5 however, the front plate has been removed.

Referring now to FIG. 5, the indicator selector 101 has been positioned to select Japanese media. It should be readily apparent that sliding indicator selector 101 also moves indicator arm 103 in the same direction. This allows lever 50 to be retracted within media tray housing 10. As shown in FIG. 6, indicator arm 103 has completely moved lever 50 internal to media tray 10.

Figure 7:
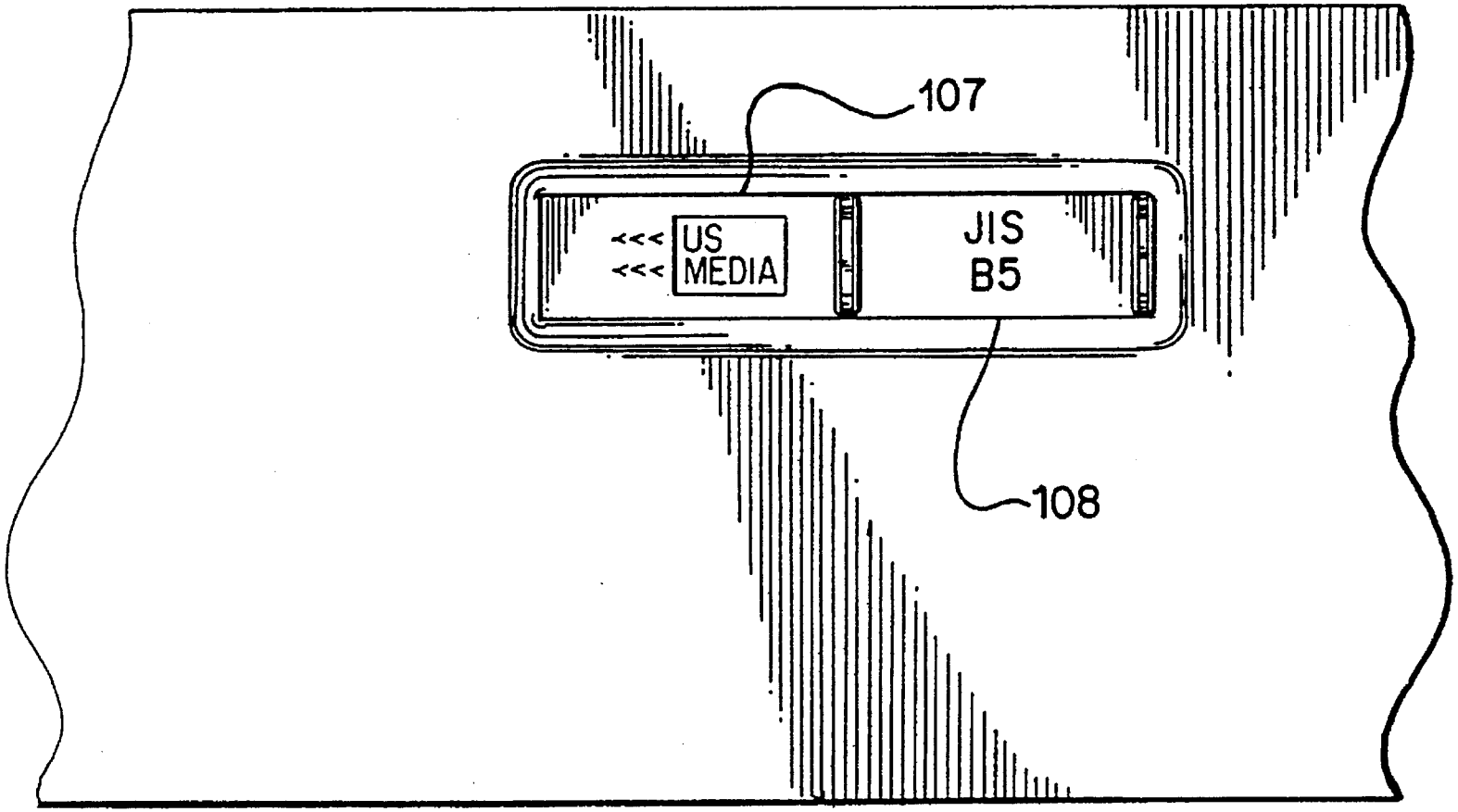
FIG. 7 is front view showing the indicator selector in greater detail.

The remaining levers 51 through 56 are identical to those shown in FIGS. 2 and 3. The front of media tray 10 with indicator selector 101 in the right position would appear to the user as shown in FIG. 7.

Figure 8:
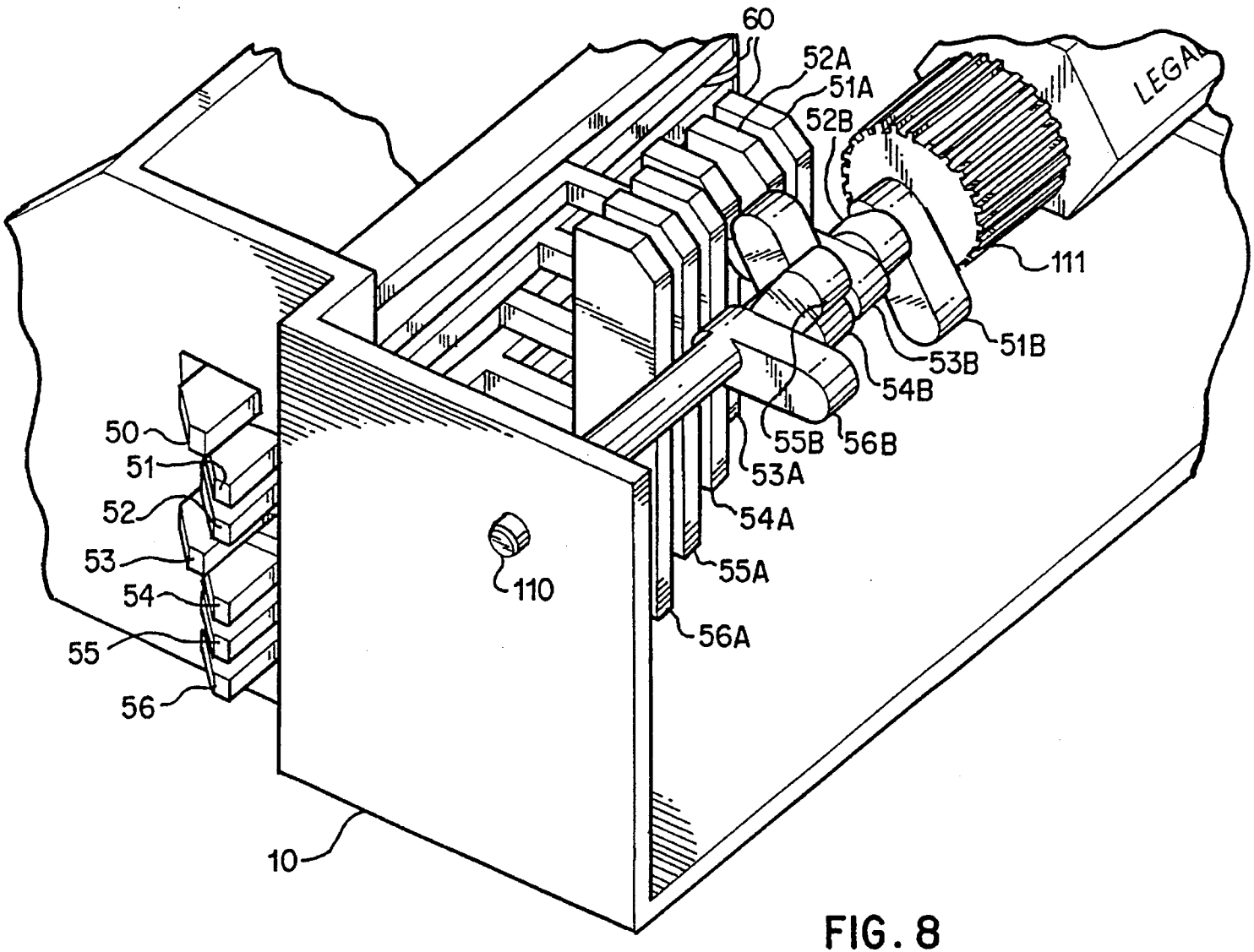
FIG. 8 provides a close-up, cut-away view showing the inner workings of the first embodiment.

Referring now to FIG. 8, the inner workings of the first embodiment is shown in greater detail. Looking at levers 50–56 shows that lever 53 and 50 are in the extended position. Lever 50, as described above has been extended as a result of sliding indicator selector 101. Lever 53 is extended because tab 53A is engaged by lobe 53B. Remaining cams are shown in their relaxed position. This information, with the aid of table 1, reveals that US Envelope has been selected.

Lobes 51B–56B of cam 102, which are attached to shaft 110, are rotated by the user's rotation of thumb wheel 111. As the user rotates thumb wheel 111, a single lobe engages with its respective tap causing the appropriate lever to rotate about pivot point 60. As stated before, one skilled in the art will understand that the present embodiment shown in FIG. 8 activities a single lever for each possible media size for one of two groups.

Figure 9:
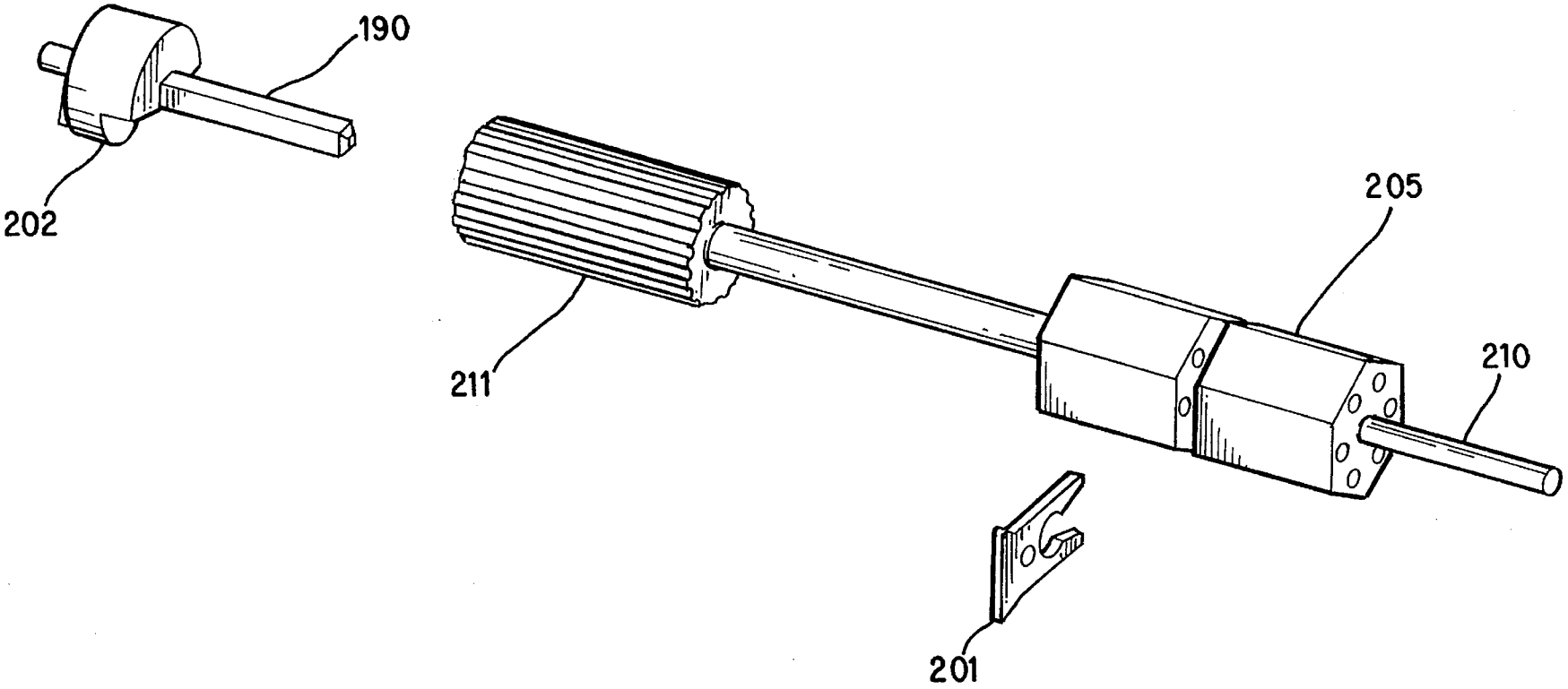
FIG. 9 is an exploded view of the primary mechanism of a second embodiment.

Referring now to FIG. 9, where a second embodiment is shown. Size indicator wheel 205 and thumb wheel 211 are spatially fixed along the axis of shaft 210. Rectangular shaft 190 of cam 202 is inserted in shaft 210 through an opening located adjacent to thumb wheel 211. This arrangement allows cam 202 to telescope in and out of thumb wheel 211. Window slider 201 allows a user to laterally move the rigid combination of thumb wheel 211 and size indicator wheel 205. Additionally, the user may rotate thumb wheel 211 thereby rotating size indicated wheel 205 and cam 202.

Figure 10:
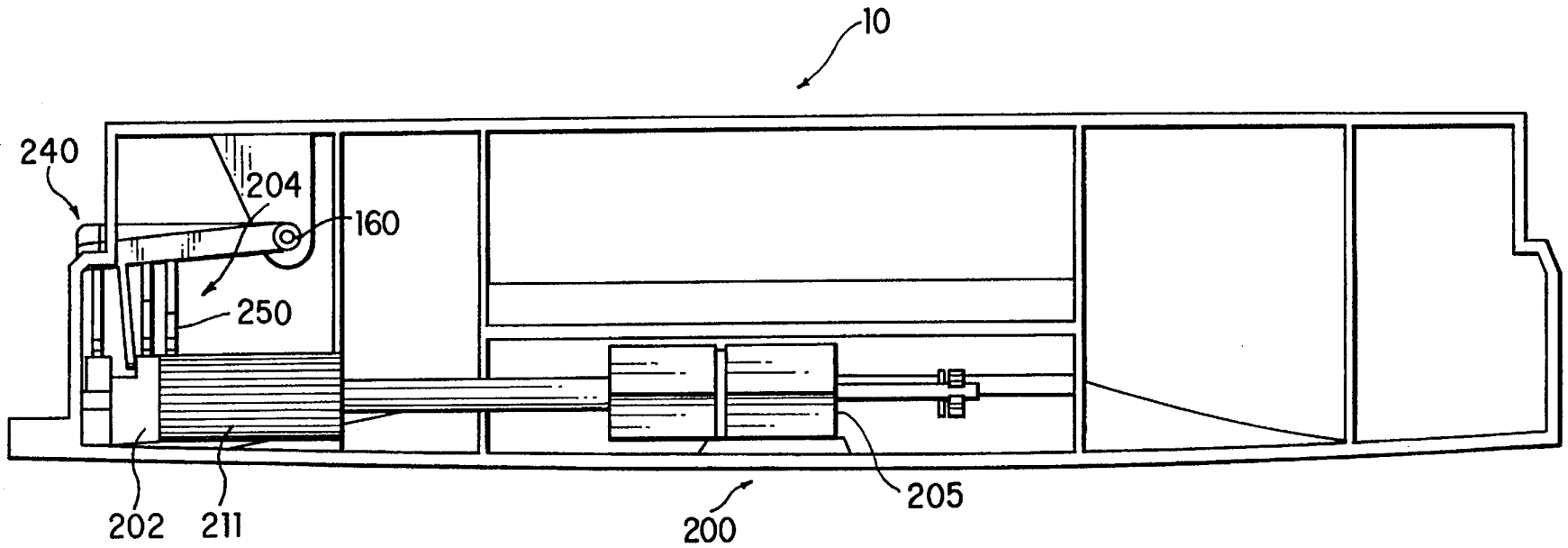
FIG. 10 provides a top view of the second embodiment showing the selection mechanism set for US paper.

In FIG. 10, the mechanism of FIG. 9 has been inserted into the front of a media tray 10. As shown in FIG. 10, thumb wheel 211 and size indicator wheel 205 are positioned for U.S. paper size. In detail, size indicator wheel 205 is shown such that the right section is visible through window 200. This positioning also positions thumb wheel 211 such that lever 250 is in contact with thumb wheel 211. Such contact rotates lever 250 about pivot point 160 thereby extending tab 350 to the "on" position. As thumb wheel 211 rotates to display alternative faces of size indicator wheel 205 in window 200, the geometric features of cam 202 manipulate levers 204 thereby pivoting them about pivot point 160 to arrange tabs 351–353 to indicate to the printing system the media size currently selected.

Figure 11:
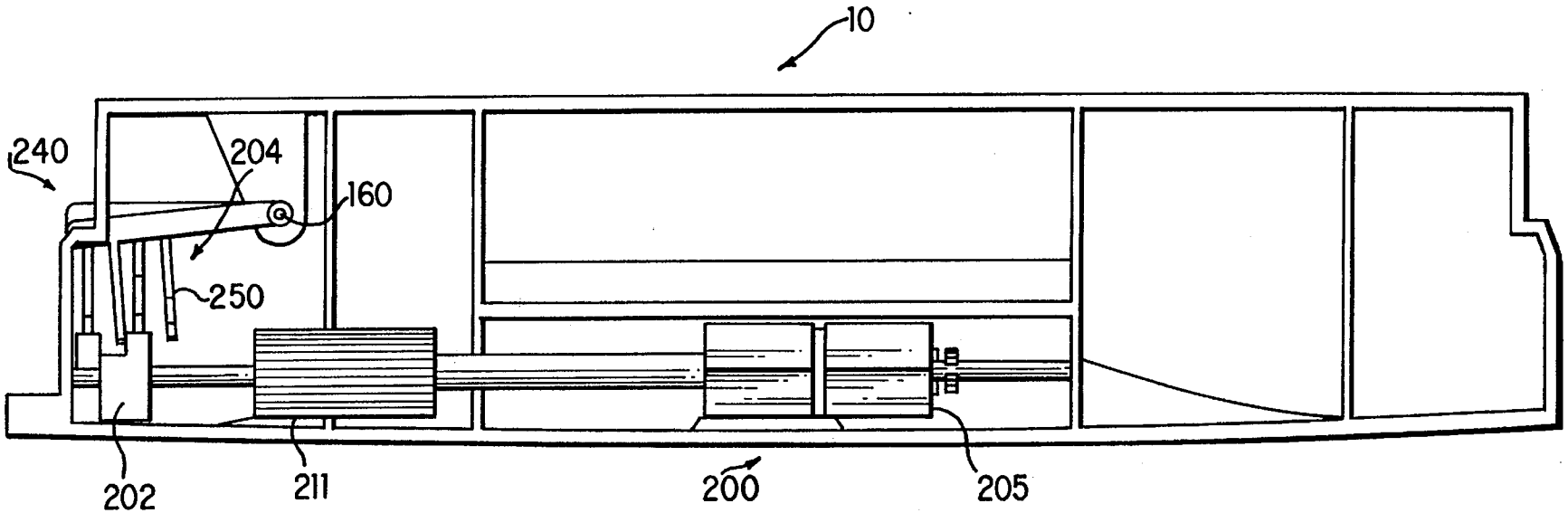
FIG. 11 provides a top view of the second embodiment showing the selection mechanism set for metric paper.

If the user laterally moves window slider 201 towards the right, size indicator wheel 205 and thumb wheel 211 also shift in a rightward manner as can be seen in FIG. 11. This arrangement shows the configuration for metric paper. Here, the left section of size indicator wheel 205 is now visible in window 200. More importantly, lever 250 no longer has physical contact with thumb wheel 211. Thus, lever 250 pivoting about pivot point 160 moves tab 350 to the "off" position.

Figure 12:
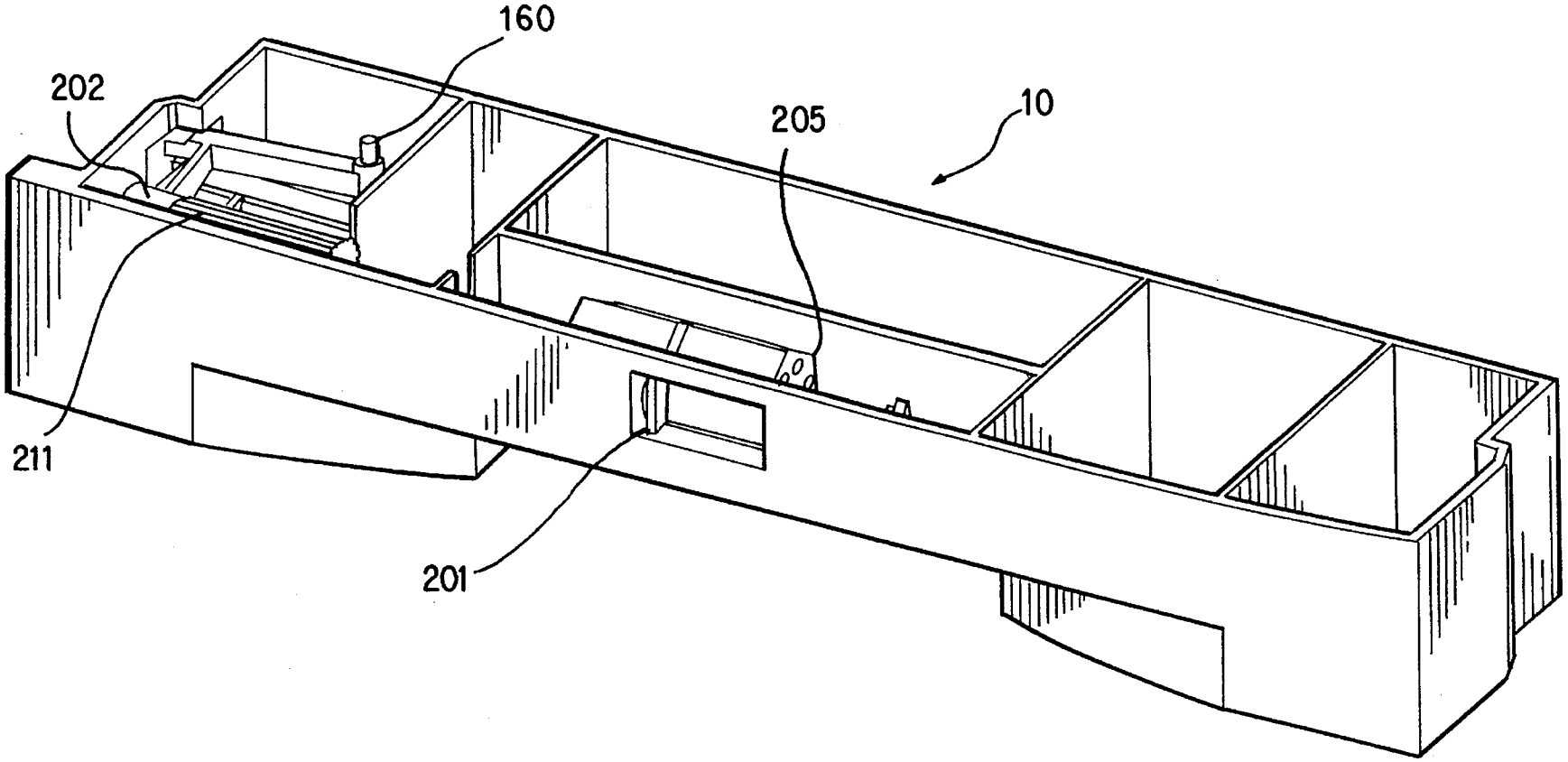
FIG. 12 provides a isometric view of the second embodiment showing the selection mechanism set for US paper.
Figure 13:
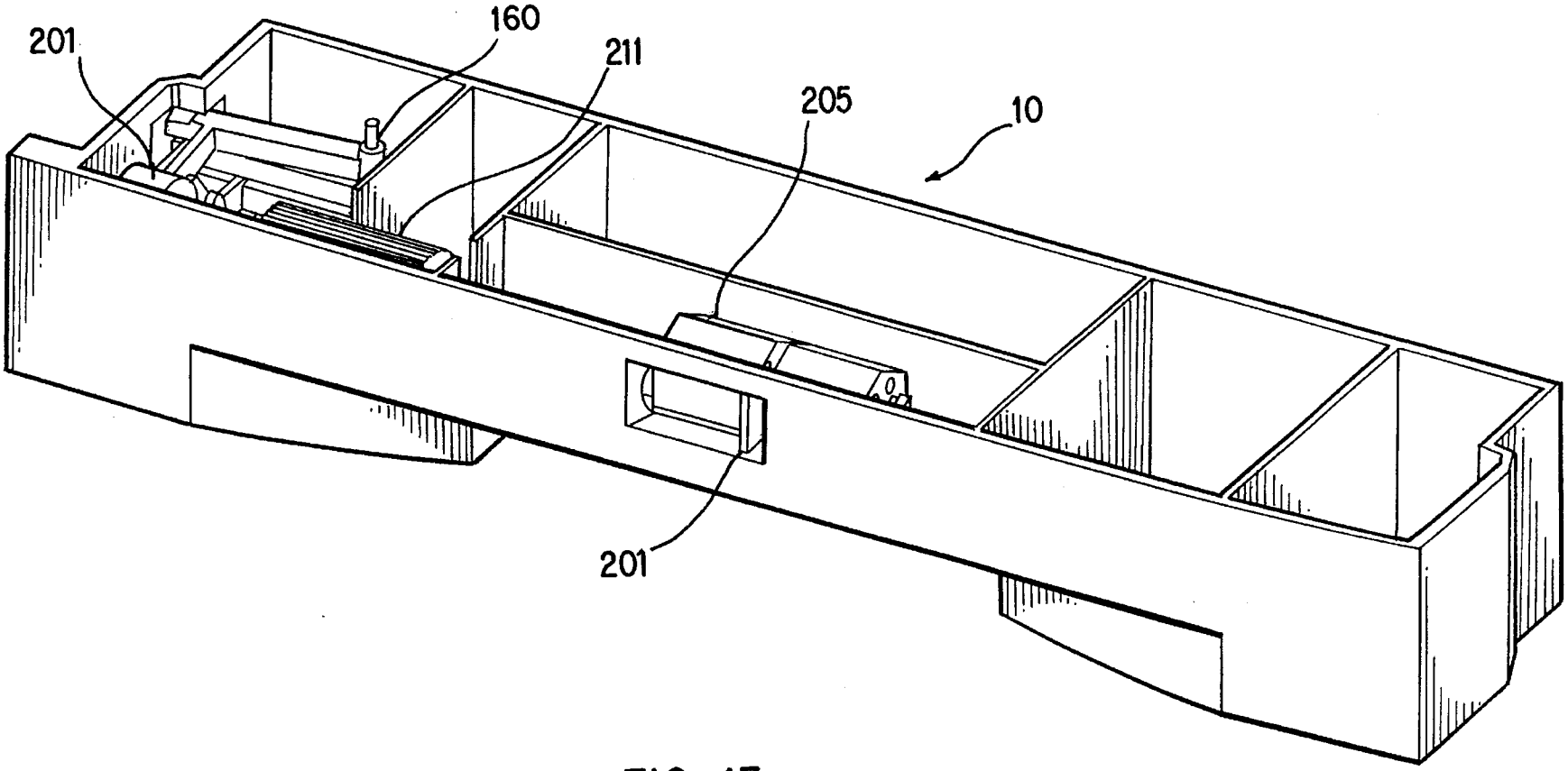
FIG. 13 provides a isometric view of the second embodiment showing the selection mechanism set for metric paper.

FIG. 12 provides an isometric view better showing the window slider 201 and thumb wheel 211, and size indicator wheel 205 arranged for U.S. paper selection. In a similar manner, FIG. 13 shows the mechanism arranged for metric size papers.

Figure 14:
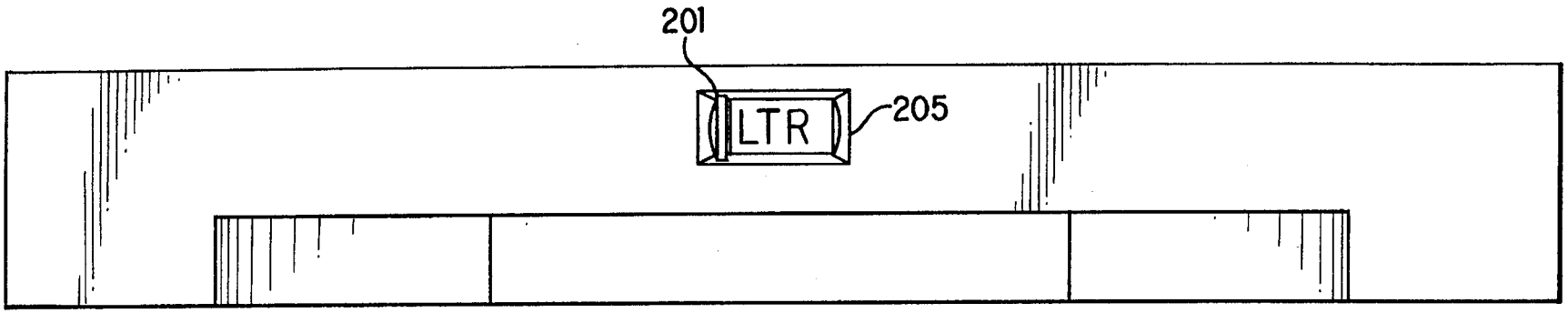
FIG. 14 provides a front view of the second embodiment showing the selection mechanism set for US paper.
Figure 15:
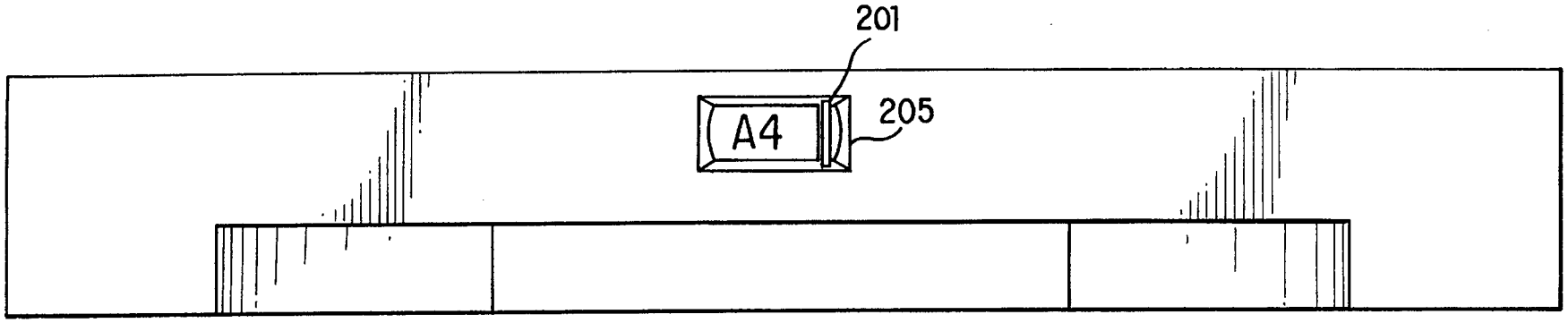
FIG. 15 provides a front view of the second embodiment showing the selection mechanism set for metric paper.
Figure 16:
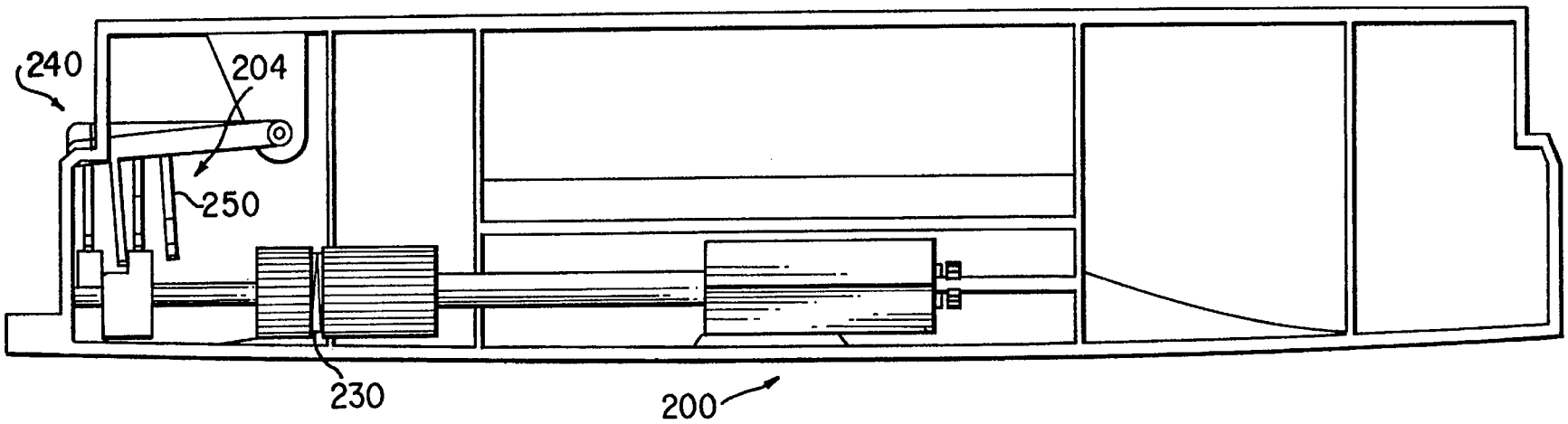
FIG. 16 provides a top view of the second embodiment showing the selection mechanism set for metric paper.
Figure 17:
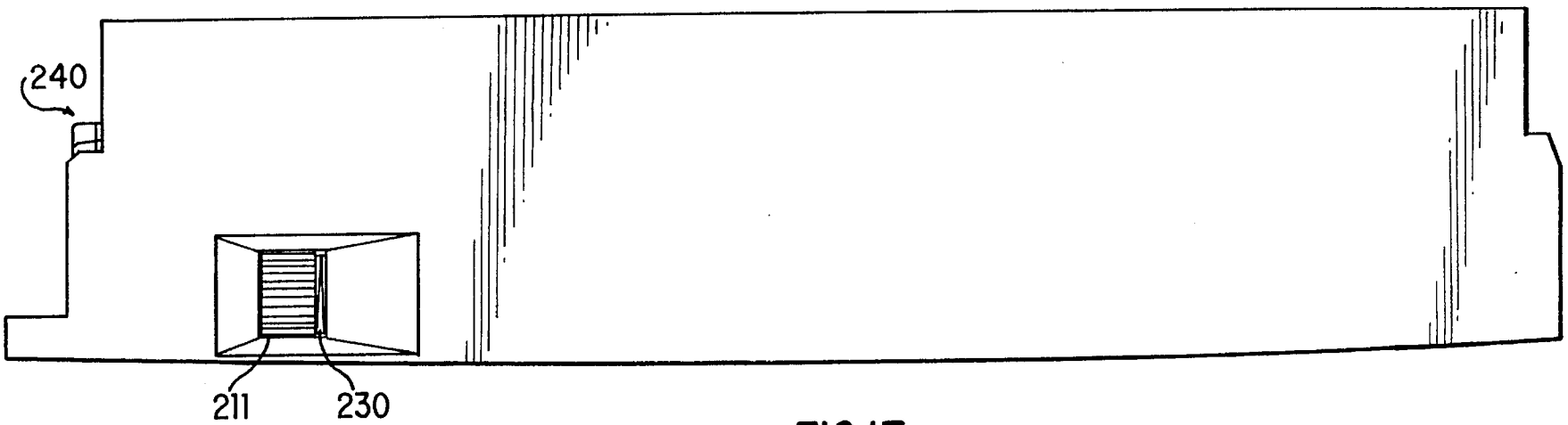
FIG. 17 provides a top view of the second embodiment showing the selection mechanism set for metric paper.

Front views of media tray 10 showing U.S. paper size selection and metric size selection are shown in FIGS. 14 and 15 respectively. FIG. 16 shows the addition of indicator 230 to thumb wheel 211. Indicator 230 provides visual indication, when viewed from the top as shown in FIG. 17, to the user indicating which media group is presently selected.

Table 2 provides the "truth" table for the second embodiment. Tab 350 indicates to the printer whether U.S. or metric is selected, while the other three tabs encode the media size. Contrary to the first embodiment, the second embodiment uses a binary encoding to indicate the media size to the printer. By using this encoding, only three levers are needed to encode the five media sizes in a group. One skilled in the art would understand that the number of possible media sizes may be increased by adding additional lobes to cam 202. Each new lobe doubles the previous number possible media sizes. Thus, with the present cam, a total of 8 media sizes can be encoded. By adding one additional lobe to cam 202, 16 sizes can be encoded. It is also possible to arrange cam 202 to activate a single lever for each possible media size for one of two groups as shown and described above.

Figure 18:
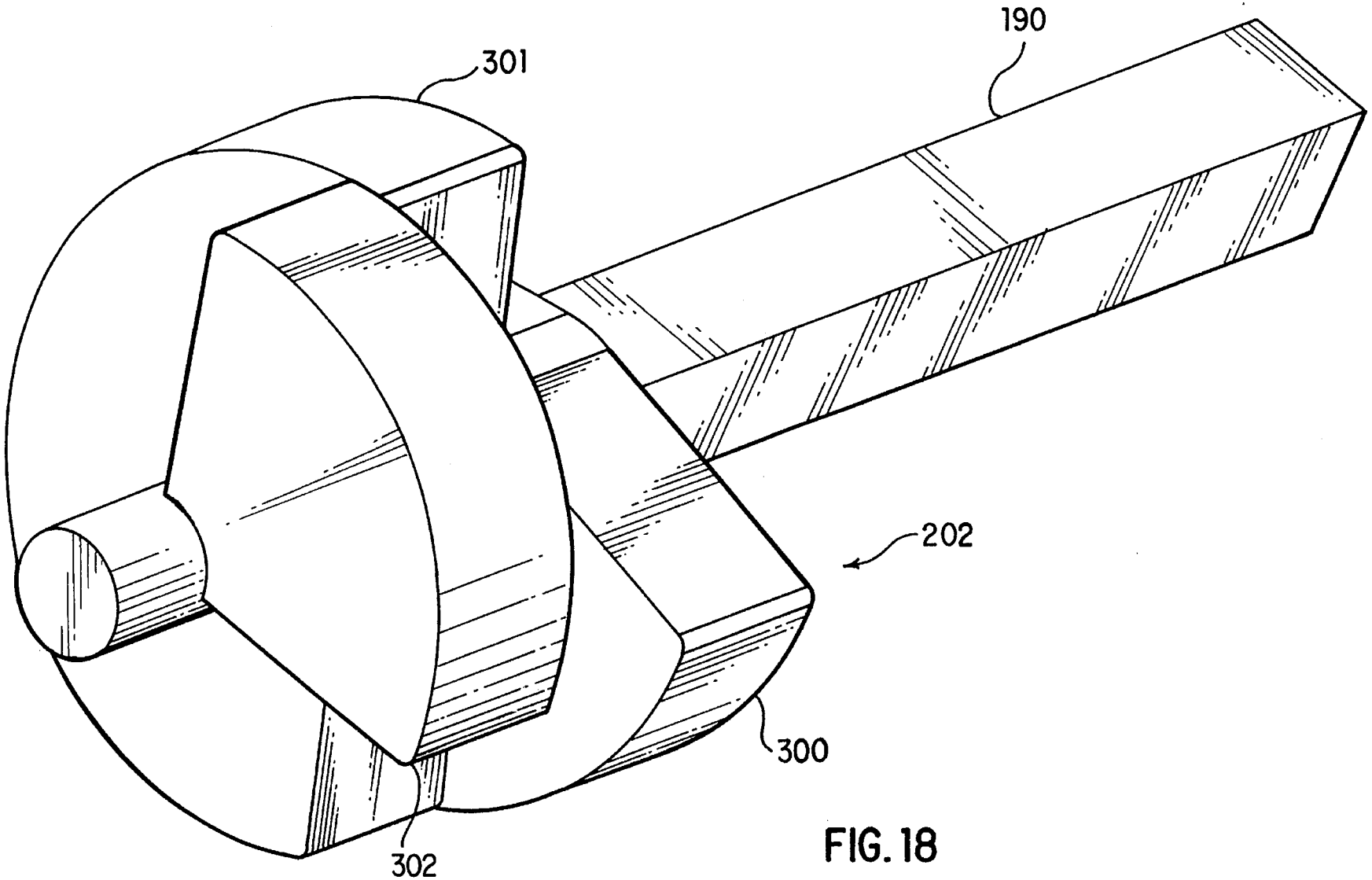
FIG. 18 is an exploded view that better shows the cam.

Referring now to FIG. 18. Cam 202 has three lobes 300, 301, and 302 formed therein. Each lobe is formed by removing a portion of circular shape. By modifying the size of the remaining circular piece of these lobes, the truth table of table 2 may be changed. One skilled in the art will understand that there is a minimum angle of inclusion for a lobe for structural reasons. Angle of inclusion is defined here to mean the angular portion of a circle which forms the lobe. For example, lobe 302 has an angle of inclusion of approximately 90 degrees. Additionally, there is a maximum angle of inclusion for a lobe. If a lobe is larger than the maximum angle of inclusion, its corresponding lever will not travel enough to move the tab from the "on" position to the "off" position.

Figure 19:
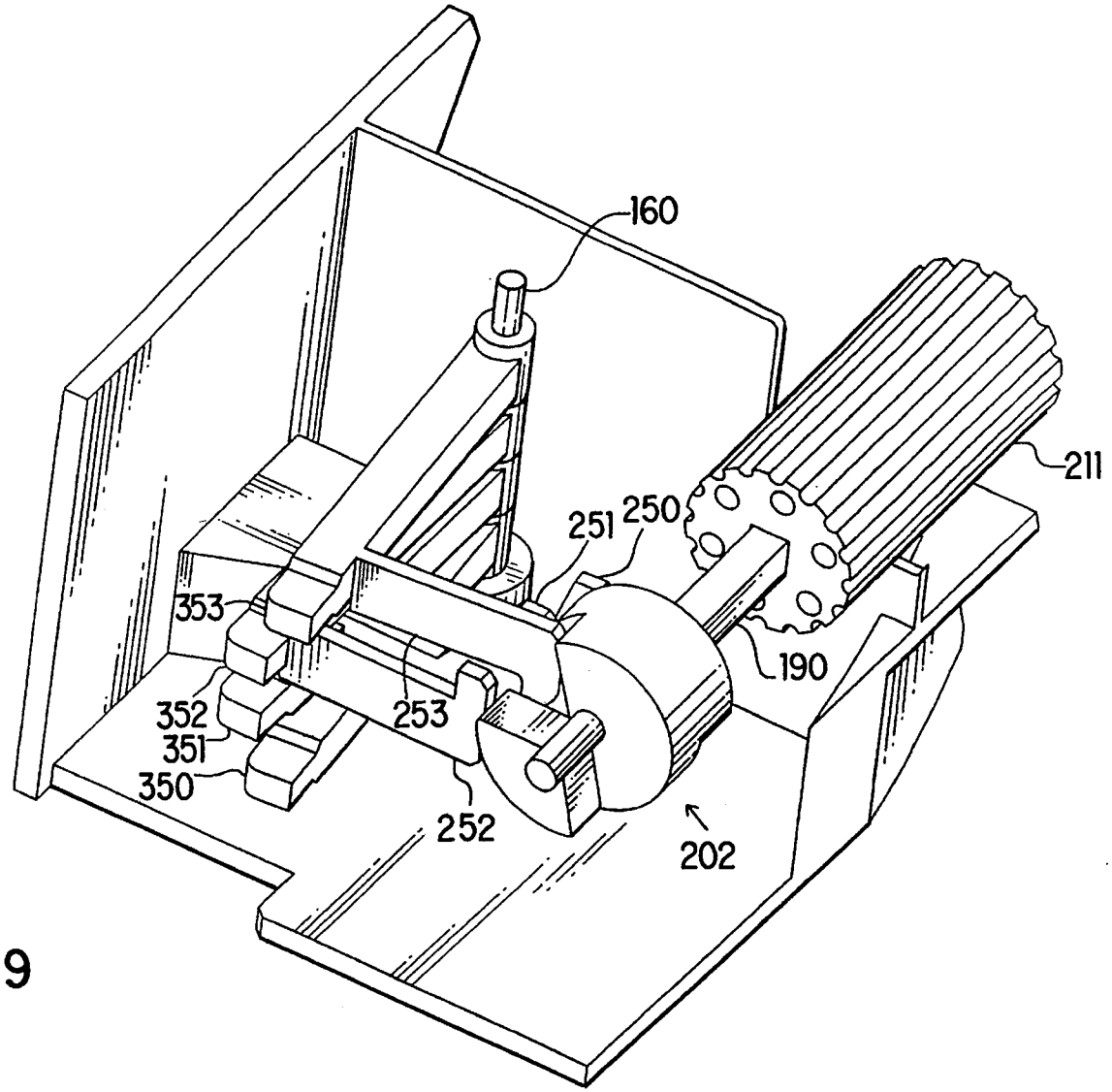
FIG. 19 provides a close-up, cut-away view showing some of the inner workings of the second embodiment

Finally, FIG. 19 provides an exploded view showing the interaction of cam 202, levers 250–253 and tabs 350–353. Here, tab 350, which is activated by lever 250, can be seen on the bottom. As thumb wheel 211 is laterally manipulated, lever 250 moves tab 350. Similarly, rotation of thumb wheel 211 rotates cam 202. Rotation of cam 202 allows the individual lobes to manipulate levers 251–253, which in turn manipulate tabs 351–353.

While the preferred embodiment has been described in conjunction with an electrophotographic printer, the present invention is equally applicable to other systems. Such systems include facsimile machines, ink jet printers, dot matrix printers, copiers and the like.

Although the preferred embodiment of the invention has been illustrated and that form described, it is readily apparent to those skilled in the art that various modifications may be made therein without departing from the spirit of the invention or from the scope of the appended claims.

TABLE 1

| Extended Lever | Media Size Indicator 50 extended | 50 retracted |
|---|---|---|
| 51 | US Letter | B5 |
| 52 | US Postcard | JIS Postcard |
| 53 | US Envelope | JIS Envelope |
| 54 | US Ledger | A3 |
| 55 | US Legal | A4 |
| 56 | US Executive | B4 |

TABLE 2

| Paper Size | Tab 351 | Tab 352 | Tab 353 | Tab 350 |
|---|---|---|---|---|
| Letter | 1 | 0 | 1 | 1 |
| Legal | 0 | 1 | 1 | 1 |
| 11 × 17 | 0 | 1 | 0 | 1 |

TABLE 2-continued

| Paper Size | Tab 351 | Tab 352 | Tab 353 | Tab 350 |
|---|---|---|---|---|
| Executive | 1 | 1 | 0 | 1 |
| B5 | 1 | 1 | 1 | 0 |
| B4 | 1 | 0 | 1 | 0 |
| A5 | 0 | 1 | 1 | 0 |
| A4 | 0 | 1 | 0 | 0 |
| A3 | 1 | 1 | 0 | 0 |

What is claimed is:

1. An apparatus for conveying a media's size to a printing system, said apparatus comprising:

a shaft having a radius and being rotated about an axis;

a cam attached to said shaft, said cam having a plurality of lobes extending beyond said radius of said shaft;

a plurality of levers, each of said plurality of levers having a first end that pivots about a pivot point and a second end, said first end positioned adjacent to one of said plurality of lobes, said second end being in contact with said printing system;

an indicator wheel attached to said shaft, said indicator wheel having a first plurality of faces located around a circumference of said indicator wheel where each face of said first plurality of faces indicates a media size, said indicator wheel further having a second plurality of faces located around said circumference of said indicator wheel where each face of said second plurality of faces indicates a media size; and a slidable lever positioned adjacent to said indicator wheel and having a first and a second position, said first position of said slidable lever indicating to said printing system that said first plurality of faces are in use, said second position of said slidable lever indicating to said printing system that said second plurality of faces are in use.

2. The apparatus of claim 1 further comprising:

a second indicator wheel attached to said shaft, said second indicator wheel having a first plurality of faces located around a circumference of said second indicator wheel where each face of said first plurality of faces indicates a media size, said second indicator wheel further having a second plurality of faces located around said circumference of said second indicator wheel where each face of said second plurality of faces indicates a media size; and said first position of said slidable lever providing visual indication that said first plurality of faces are in use, said second position of said slidable lever providing visual indication that said second plurality of faces are in use.

3. The apparatus of claim 1 further comprising a thumb wheel attached to said shaft.

4. The apparatus of claim 2 wherein said slidable lever further comprising:

a opening for viewing portions of said second indicator wheel; and a tab in contact with said printing system when said slidable lever is in said first position.

5. An apparatus for conveying a media's size to a printing system, said apparatus comprising:

a shaft having a radius and being rotated about an axis;

a cam attached to said shaft, said cam having a lobe extending beyond said radius of said shaft;

a lever having a first end that pivots about a pivot point and a second end, said lever further having a tab between said first end and said second end, said tab positioned adjacent to said cam and being in contact with said lobe, said second end being in contact with said printing system;

an indicator wheel attached to said shaft, said indicator wheel having a first and a second media size indicator; and a slidable lever positioned adjacent to said indicator wheel and having a first and a second position, said first position of said slidable lever indicating to said printing system that said first media size indicator is in use, said second position of said slidable lever indicating to said printing system that said second media size indicator is in use.

6. The apparatus of claim 5 further comprising a thumb wheel attached to said shaft.

7. The apparatus of claim 5 further comprising:

a second indicator wheel attached to said shaft, said second indicator wheel having a first and a second media size indicator; and said first position of said slidable lever providing visual indication that said first media size indicator of said second indicator wheel in use, said second position of said slidable lever providing visual indication that said second media size indicator of said second indicator wheel is in use.

8. An apparatus for conveying a media's size to a printing system, said apparatus comprising:

a shaft having a radius and being rotated about an axis;

a cam attached to said shaft, said cam having a plurality of lobes extending beyond said radius of said shaft;

a plurality of levers in mechanical contact with said cam, each lever of said plurality of levers pivoting about a pivot point from a first position to a second position when a corresponding lobe moves a lever;

an indicator wheel attached to said shaft, said indicator wheel having a first plurality of faces located around a circumference of said indicator wheel where each face of said first plurality of faces indicates a media size, said indicator wheel further having a second plurality of faces located around said circumference of said indicator wheel where each face of said second plurality of faces indicates a media size; and a slidable lever positioned adjacent to said first indicator wheel and having a first and a second position, said first position of said slidable lever indicating to said printing system that said first plurality of faces are in use, said second position of said slidable lever indicating to said printing system that said second plurality of faces are in use.

9. The apparatus of claim 8 further comprising:

a window for selectively viewing one of either said first plurality of faces or said second plurality of faces of said indicator wheel, said slidable lever moving said indicator wheel parallel to an axis of said shaft, said first position of said slidable lever having said first plurality of faces visible through said window and said second position of said slidable lever having said second plurality of faces visible through said window.

10. The apparatus of claim 9 further comprising a thumb wheel slidable along said shaft, said thumb wheel being a fixed distance from said indicator wheel.

* * * * *